United States Patent [19]

Berkhof

[11] Patent Number: 4,692,574

[45] Date of Patent: Sep. 8, 1987

[54] DIFFERENTIAL PRESSURE RESPONSIVE SWITCH

[75] Inventor: Hendrikus Berkhof, Emmen, Netherlands

[73] Assignee: Honeywell B.V., Amsterdam, Netherlands

[21] Appl. No.: 854,261

[22] Filed: Apr. 21, 1986

[30] Foreign Application Priority Data

Jun. 15, 1985 [DE] Fed. Rep. of Germany ..... 3521646

[51] Int. Cl.[4] ..... H01H 35/32

[52] U.S. Cl. ..... 200/81.5; 200/83 Y; 200/83 Q; 137/82; 91/47

[58] Field of Search ..... 137/82; 91/47, 1, 461; 340/606, 611, 626; 200/153 T, 83 Q, 83 R, 83 Y, 83 S, 83 SA, 81.4, 81.5, 81.9 R

[56] References Cited

U.S. PATENT DOCUMENTS 3,277,441 10/1966 Gutjahr ..... 200/81.4
3,681,546 8/1972 Coin ..... 137/82
3,852,547 12/1974 Dietz ..... 200/834
4,217,471 8/1980 Ulbing ..... 91/47
4,330,695 5/1982 Poling ..... 200/83 S

*Primary Examiner*—G. P. Tolin
*Attorney, Agent, or Firm*—Mitchell J. Halista; Albin Medved

[57] ABSTRACT

A differential pressure responsive switch utilizes an operating diaphragm which has a position controlled by a pressure being monitored with the diaphragm acting through a transmission member upon an electrical switch and includes a first chamber divided by a control diaphragm and having an inlet for the pressure to be monitored to one side of the control diaphragm while the other side of the control diaphragm carries a closure member for an adjacent bleed valve seat. An inlet for the bleed valve is connected via a throttle to a source of a pressurized gas and to a second chamber defined by the operating diaphragm and a spring is engaged through the transmission member to urge the operating diaphragm against the pressure in the second chamber.

9 Claims, 2 Drawing Figures

DIFFERENTIAL PRESSURE RESPONSIVE SWITCH

BACKGROUND OF THE INVENTION

1. Field of the Invention

The present invention is related to a pressure controlled switch. More specifically, the present invention is directed to a differential pressure responsive switch.

2. Description of the Prior Art

Pressure controlled switches are well-known in the art. However, if such conventional switches are used for monitoring a low pressure, a relatively large area diaphragm is required for generating the necessary switching force. Furthermore, an exact adjustment of such low pressure switches and the maintenance of such an adjustment over a long period of time is difficult because of the low pressure whereby small changes of the diaphragm properties, e.g., resulting from aging, or mechanical hysteresis in the switch operating mechanism, lead to undesirable changes in the response of the switch. Accordingly, it is desirable to provide a pressure switch which overcomes the aforesaid problems when being used to monitor low pressures.

SUMMARY OF THE INVENTION

An object of the present invention is to provide an improved differential pressure responsive switch capable of monitoring low pressures while exhibiting long term stability.

In accomplishing this and other objects, there has been provided, in accordance with the present invention, a differential pressure responsive switch including an operating diaphragm having a position controlled by the pressure which is to be monitored and acting via a transmission member upon an electrical switch comprising a first chamber divided by a control diaphragm, an inlet means for applying the pressure which is to be monitored to one side of the control diaphragm, a bleed valve having a closure member carried by the other side of the control diaphragm and a valve seat, a throttle means for connecting the side of the valve seat which is opposite to the control diaphragm to a source of operating pressure, pipe means for connecting the side of the valve seat to the second chamber which is closed by the operating diaphragm and a spring means for engaging the transmission member and acting against the pressure acting on the operating diaphragm in the second chamber.

BRIEF DESCRIPTION OF THE DRAWINGS

A better understanding of the present invention may be had when the following description is read in connection with the accompanying drawings, in which.

DESCRIPTION OF THE PREFERRED EMBODIMENT

Detailed Description

Figure 1:
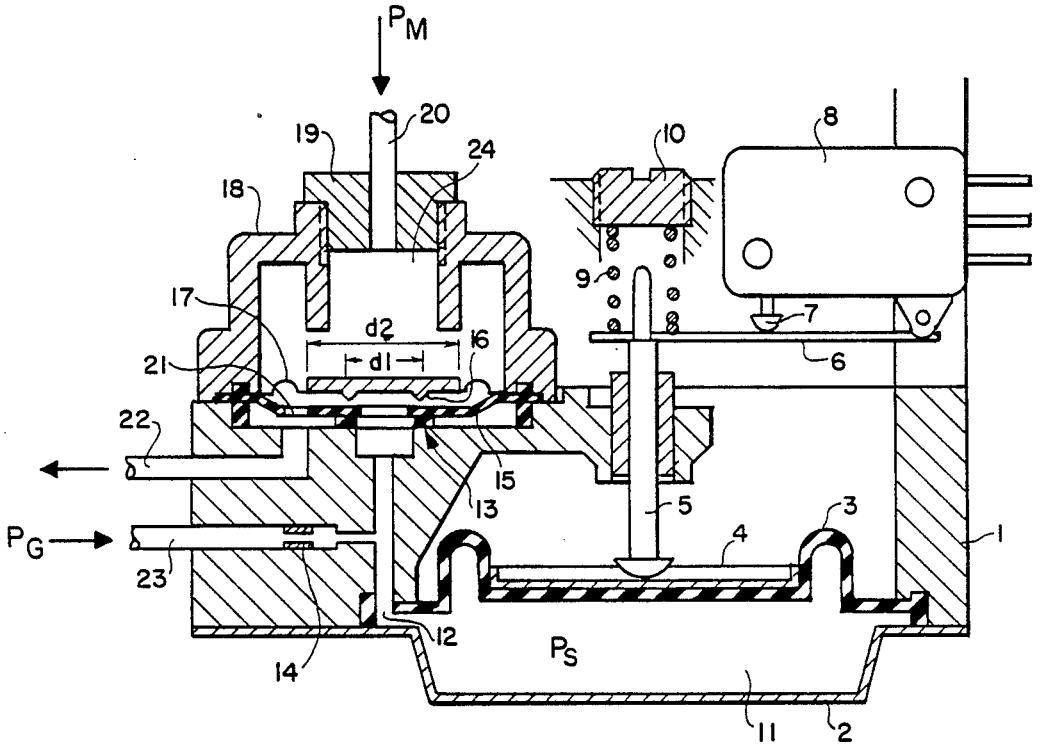
FIG. 1 is a cross-sectional illustration of a differeential pressure controlled switch embodying a first example of the present invention and FIG. 2 is a cross-sectional illustration of a differential pressure responsive switch embodying a second example of the present invention and its application for monitoring a gas heated hot water boiler with a fan operated burner.

The present invention uses the principle of pressure amplification known from servo-pressure regulators which has the capability of additional monitoring possibilities, i.e., the simultaneous monitoring of several functions. Referring to FIG. 1 in more detail, there is shown a differential pressure responsive switch utilizing a first embodiment of the present invention wherein a resilient operating diaphragm 3 is clamped with its outer circumference between a base member 1 of a valve housing and a base plate 2. The diaphragm 3 has a rigid center diaphragm plate 4 in contact with a pin 5 which via a lever 6 acts upon plunger 7 of a snap acting switch 8. A reset spring 9 abuts an adjusting screw 10 which can be adjusted in relation to the valve housing. The force of spring 9 acts against a control pressure $P_S$ within a diaphragm chamber 11 defined by the diaphragm 3. This control pressure $P_S$ exists in a pipe 12 extending between diaphragm chamber 11 and a bleed valve 13 to which a supply pressure, e.g., the pressure $P_G$ within a gas supply pipe 23 is supplied via a throttle 14. A bleed valve 13 consists of a plate shaped valve seat 15 and a ring shaped closure member 16 which is fixed to the bottom side of a resilient control diaphragm 17 coaxially with the seat 15. The closure member 16 has a first diameter $d_1$ whereas the diaphragm 17 has a larger second diameter $d_2$. The valve seat 15 together with the diaphragm 17 is sealed and clamped between housing portion 1 and a cap 18. A cover 19 of the cap 18 includes a connector 20 for a pressure $P_M$ which is to be monitored. An opening 21 in the valve seat plate 15 forms a fluid connection between the spaces above and below the valve plate 15, i.e., surrounding the valve seat 15. These spaces are connected to a bleed pipe 22.

If a supply or operating pressure $P_G$ is fed to the inlet 23, a control pressure for operating the switch 8 cannot build-up behind the throttle 14 and in the actuator chamber 11 as long as no pressure acting against this control pressure is present in the chamber 24 above the diaphragm 17. The pressure in the chamber 11, which simultaneously is present at the diaphragm 17 via the pipe 12, lifts this diaphragm together with closure member 16 away from valve seat 15. Thus, the servo or bleed valve 13 is wide open, and the pressure generated in channel 12 is bled off via bleed pipe 22. A normally open contact of the switch 8 may be used in the energizing circuit of a solenoid valve (not shown) controlling the gas supply to a burner. This valve remains closed, i.e., unenergized, until the switch 8 is operated via diaphragm 3, plate 4, pin 5, lever 6 and plunger 7 by a control pressure build-up in the actuator chamber 11.

The pressure switch of the present invention may be used to ensure that the gas supply to the burner is not switched on before a fan supplying the combustion air generates a sufficient pressure of the combustion air. This combustion air pressure $P_M$ which is to be monitored is fed via the connector 20 to the chamber 24 above the diaphragm 17 and thereby presses the diaphragm 17 toward the bleed valve 13. The pressure $P_M$ thus reduces the free passage between the bleed valve elements 15,16 by means of the diaphragm 17 by moving the ring-shaped closure member 16 connected to the diaphragm 17 toward the seat 15. Concurrently, the diaphragm 3 together with the pin 5 is moved upwards, and the lever 6 is pivoted toward the plunger 7. As soon as the pressure $P_M$ reaches a predetermined minimum value, the switch 8 is operated via the plunger 7. As a result, the gas supply to the burner is opened via the above mentioned solenoid valve. In the application as mentioned, the pressure switch of FIG. 1 monitors not only the pressure $P_M$ of the combustion air but simultaneously the gas supply pressure $P_G$ because without such a gas supply pressure no operating pressure can be built-up within the channel 12 and in the diaphragm chamber 11 to move the diaphragm 3 and the pin 5. In this case, with a single pressure operated switch the pressure of the combustion air as well as the gas supply pressure can be concurrently monitored.

The forces acting upon the diaphragm 17 include the pressure $P_M$ multiplied with the effective diaphragm surface $S_2$, corresponding to diameter $d_2$ and, from below, the pressure $P_S$ multiplied with the diaphragm surface $S_1$ in the valve seat 16 (diameter $d_1$). When the force acting from above on the diaphragm 17 and depending on the monitored pressure $P_M$ exceeds the force acting from below which is derived from the supply pressure $P_S$, the flow past the bleed valve elements 15,16 increases the pressure within the diaphragm chamber 11 until it can operate the switch 8. Since surface $S_2$ is essentially larger than surface $S_1$, valve elements 15,16 can be controlled by a relatively low pressure and therewith switch 8 can be operated by such low pressure. The control pressure $P_S$ within the chamber 11 is amplified with respect to the pressure to be monitored by a factor which depends on the value of the gas supply pressure $P_G$ as well as on the relation of the effective diaphragm surfaces $S_1$ and $S_2$. By this pressure amplification it is possible to generate the force for operating the switch 8 by means of a diaphragm 3 of essentially smaller diameter compared to the case where pressure PM would be supplied directly into the diaphragm chamber 11. The adjustment screw 10 permits an exact adjustment of the response pressure of the pressure switch.

Figure 2:
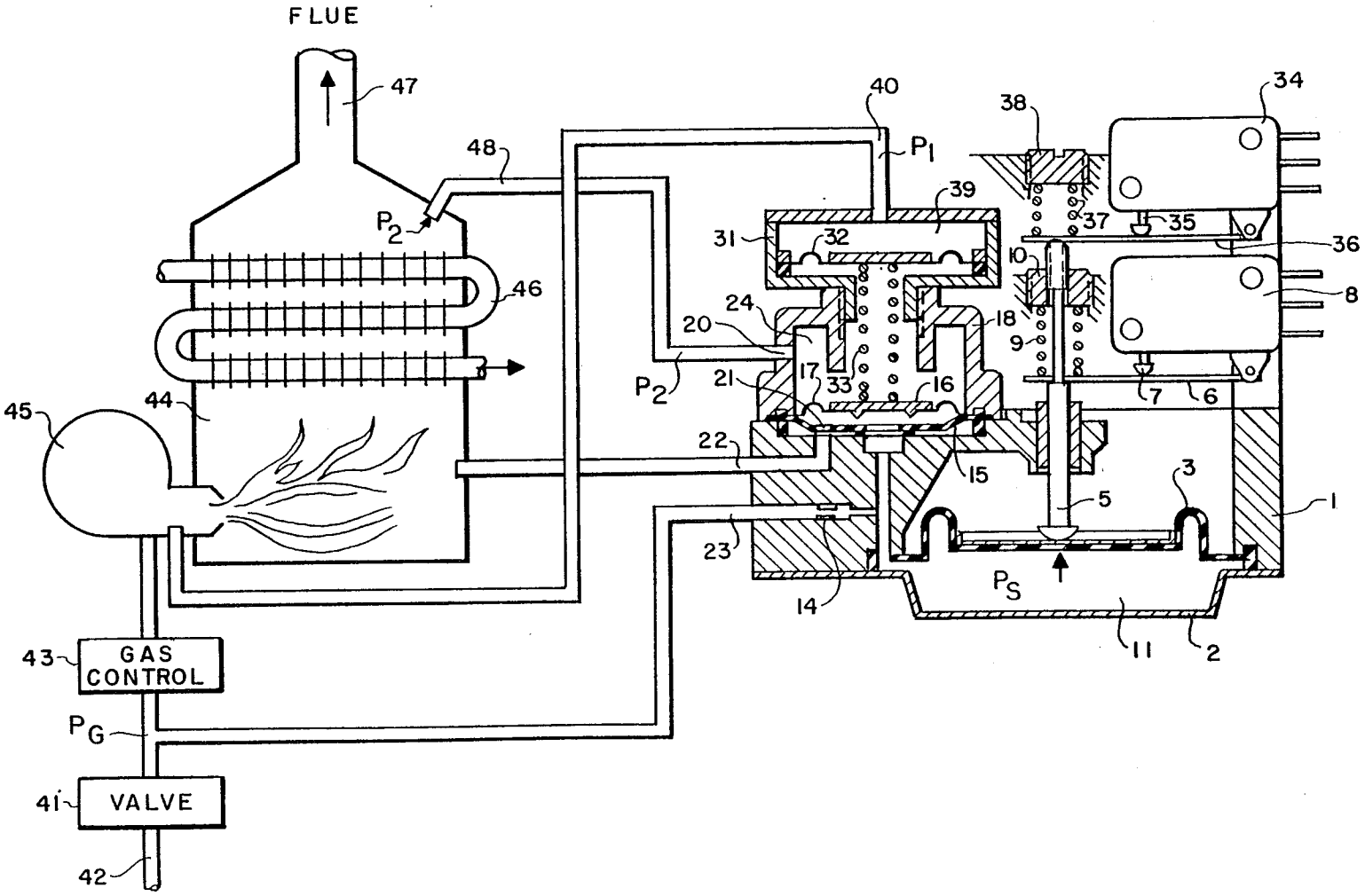

FIG. 2 shows a differential pressure responsive switch utilizing a second embodiment of the present invention in an application for monitoring a gas heated hot water boiler with a fan supported burner. As far as elements of the differential pressure switch shown in FIG. 2 correspond to those of FIG. 1, the same reference numerals are used. In addition to the first control diaphragm 17, a second control diaphragm 32 is provided in a housing 31 which, in turn, is mounted on a cap 18. This second diaphragm 32 transmits its force to the first control diaphragm 17 via a spring 33. The housing 31 further comprises a pressure inlet 40. In addition to the switch 8, a second switch 34 is provided having a plunger 35 also operated by the end of the pin 5 via a lever 36. The lever 36 is spring biased by a spring 37 which abuts against an adjusting screw 38.

Pressure inlet 23 is connected to a gas supply pipe 42 via a safety valve 41. A gas control apparatus 43 controls the gas supply to a combustion chamber 44 dependent on the demand of heat from the system heated by the combustion chamber 44. The bleed pipe 22 ports into the lower portion of chamber 44. A fan 45 generates a pressure $P_1$ for the combustion air and moves this combustion air into the combustion chamber 44. The combustion air pressure simultaneously reaches the inlet chamber 39 of the cup-shaped housing 31 via the pipe 40 and thereby acts upon the diaphragm 32. Heating water flows through the heat exchanger 46. In the vicinity of an outlet or exhaust channel 47 to a flue, a pipe 48 ports into combustion chamber 44 and transmits the pressure $P_2$ at the outlet channel 47 from the combustion chamber 44 to the control chamber 24 between the diaphragms 32 and 17 via the pipe 48 and the inlet 20. A normally open contact of switch 8 is provided in the energizing circuit of a solenoid valve, e.g., the valve (not shown) of the gas control apparatus 43. The switch 34 has a normally closed contact which can be inserted in the same energizing circuit or in the circuit of another gas valve.

As soon as the safety valve 41 is opened, the supply pressure $P_G$ reaches channel 12 via nozzle 14 and tries to build-up a corresponding control pressure within chamber 11. Without pressures $P_1$ and $P_2$ acting upon the top side of the diaphragms 17 and 32, the bleed valve elements 15,16 would open completely and would prevent generation of a pressure within the chamber 11 sufficient to operate the switch 8. When the pressure $P_1$ delivered by the fan 45 acts upon the diaphragm 32 and the diaphragm 17, the closure member 16 is urged in the direction towards the seat 15, i.e., the bleed valve 13 moves in closing direction, and the pressure within the chamber 11 increases to move the operating diaphragm 3 until the switch 8 is operated to switch on the gas supply. This is only possible if the gas supply pressure $P_G$ and the combustion air pressure $P_1$ are both present. On the diaphragms 17 and 32, however, simultaneously acts the pressure $P_2$ from the outlet of combustion chamber 44. In accordance with the effective diaphragm surface of the diaphragm 32, a force opposing the pressure $P_1$ is generated and acts upon diaphragm 32. Further, a force depending on the effective diaphragm surface of the diaphragm 17 assists the force of the spring 33. In this way, the flow of combustion gas and exhaust gas through the combustion chamber 44 can be monitored.

If because of a clogging of the flow paths past the heat exchanger 46, the gas flow areas have been reduced, the pressure $P_1$ will increase while the pressure $P_2$ will decrease. This means that the pressure differential $P_1$ will increase while the pressure $P_2$ will decrease, i.e., the pressure differential $P_1-P_2$ becomes larger. Consequently, an increased force acts upon the diaphragm 17 via the spring 33 which therefore renders the force balance at the diaphragm 17 to become effective at a higher pressure $P_S$. The resulting pressure increase within the chamber 11 effects, a repositioning of the diaphragm 3 to produce a further movement of the pin 5 and therewith an operation of the switch 34 via the lever 36 with the result that its normally closed contact switches the burner 45 off.

If the flue or the exhaust tube 47 is blocked, the pressure $P_2$ will adopt the value of pressure $P_1$, and the pressure differential will disappear. By appropriate selection of the effective diaphragm surfaces of the diaphragms 17 and 32, it can be achieved that in this case the force generated on the top side of diaphragm 17 by pressure $P_2$ increases so far until the switch 34 responds and turns the burner 45 off. The response level of the switch 34 can be adjusted by adjusting the screw 38 in connection with the spring 37. Thus, in the illustrated embodiment, the presence of the supply gas pressure, the appropriate operation of the fan and a sufficient draft in the combustion chamber and the flue are simultaneously monitored by the pressure differential controlled switch. Thus, the present invention provides a pressure controlled switch, in particular for monitoring low-pressures, which requires little space, can easily be adjusted and for its production does not need precise special parts and complicated adjustment procedures.

Accordingly, it may be seen that there has been provided, in accordance with the present invention, an improved differential pressure responsive switch capable of monitoring low pressure while exhibiting long term stability.

The embodiment of the present invention in which an exclusive property or privilege is claimed are defined as follows:

1. A differential pressure responsive switch with an operating diaphragm having a position controlled by a pressure which is to be monitored and acting via a transmission member upon an electrical switch comprising a first chamber divided by a control diaphragm, an inlet means applying the pressure which is to be monitored to one side of said control diaphragm, a bleed valve having a closure member carried by the other side of said control diaphragm and a valve seat, a throttle means connecting the side of said valve seat which is opposite to said control diaphragm to a source of operating pressure, pipe means connecting said side of said valve seat to a second chamber which is closed by the operating diaphragm and a spring means engaging the transmission member and acting against the pressure acting on the operating diaphragm in said second chamber.

2. A pressure switch according to claim 1 wherein said spring means includes an adjusting spring which acts upon the operating diaphragm.

3. A pressure switch according to claim 1 wherein said closure member includes a ring-shaped projection on said control diaphragm cooperating with said valve seat and provided on that side of said control diaphragm which faces said valve seat and that the surface surrounded by said projection is smaller than the effective surface of said control diaphragm on the opposite side which is exposed to the monitored pressure.

4. A pressure switch according to claim 1 and further including a third chamber divided by a second control diaphragm and located adjacent to said first chamber a compression spring provided between said two control diaphragms and a flow connection to said third chamber as an inlet for a second pressure to be monitored with said connection being provided at that side of said second diaphragm which is opposite to said first diaphragm.

5. A pressure switch according to claim 4 and further including a second electrical switch operable by the transmission member with the response pressure of said second switch being adjustable to a different value compared with the response pressure of said first electrical switch.

6. A system of a differential pressure responsive switch with an operating diaphragm having a position controlled by a pressure which is to be monitored and acting via a transmission member upon an electrical switch in a gas heated boiler with combustion air being supplied under pressure to a combustion chamber comprising a first chamber divided by a control diaphragm, an inlet means applying the pressure which is to be monitored to one side of said control diaphragm, a bleed valve having a closure member carried by the other side of said control diaphragm and a valve seat, a throttle means connecting the side of said valve seat which is opposite to said control diaphragm to a source of operating pressure, pipe means connecting said side of said valve seat to a second chamber which is closed by the operating diaphragm, a spring means engaging the transmission member and acting against the pressure acting on the diaphragm in the second chamber, a third chamber divided by a second control diaphragm and located adjacent to said first chamber, a compression spring provided between said two control diaphragms, a first flow connection to said third chamber as an inlet for a second pressure to be monitored with said connection being provided at that side of said second diaphragm which is opposite to said first diaphragm, a second flow connection from said inlet means for said first chamber to the exhaust side of the combustion chamber, a third flow connection from said first flow connection to said third chamber to a combustion air supply, a fourth flow connection from the bleed off side of said bleed valve to the combustion chamber and a fifth flow connection from said throttle means to an operating pressure supply pipe.

7. A system as set forth in claim 6 wherein said spring means includes an adjusting spring which acts upon the operating diaphragm.

8. A system as set forth in claim 6 wherein said closure member includes a ring-shaped projection on said control diaphragm cooperating with said valve seat and provided on that side of said control diaphragm which faces said valve seat and that the surface surrounded by said projection is smaller than the effective surface of said control diaphragm on the opposite side which is exposed to the monitored pressure.

9. A system as set forth in claim 6 and further including a second electrical switch operable by the transmission member with the response pressure of said second switch being adjustable to a different value compared with the response pressure of said first electrical switch.

* * * * *